US008413569B1

(12) United States Patent
Helton

(10) Patent No.: US 8,413,569 B1
(45) Date of Patent: Apr. 9, 2013

(54) PARALLEL ACTUATOR GUN MOUNT

(75) Inventor: Justin R. Helton, Fredericksburg, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 40 days.

(21) Appl. No.: 13/317,037

(22) Filed: Sep. 28, 2011

(51) Int. Cl.
*F41A 27/00* (2006.01)
*F41A 23/00* (2006.01)

(52) U.S. Cl.
USPC ..... 89/37.12; 89/37.01

(58) Field of Classification Search ..... 89/37.01, 89/37.03, 37.05, 37.07, 37.09, 37.12, 37.14, 89/37.16, 38, 40.01, 40.06
See application file for complete search history.

(56) References Cited

U.S. PATENT DOCUMENTS

| | | | | | |
|---|---|---|---|---|---|
| 2,236,312 | A | * | 3/1941 | Funk | 89/37.16 |
| 2,694,342 | A | * | 11/1954 | Abel | 89/37.13 |
| 2,858,740 | A | * | 11/1958 | Harring et al. | 89/40.01 |
| 4,440,061 | A | * | 4/1984 | Magnuson | 89/41.12 |
| 5,031,832 | A | | 7/1991 | Ratnik et al. | 239/14.2 |
| 5,202,695 | A | * | 4/1993 | Hollandsworth et al. | 342/359 |
| 5,429,032 | A | * | 7/1995 | Cytron | 89/37.05 |
| 5,631,437 | A | | 5/1997 | LaVigna et al. | 89/14.3 |
| 5,633,716 | A | | 5/1997 | Corby, Jr. | 356/375 |
| 5,845,427 | A | | 12/1998 | Taylor | 42/94 |
| 6,715,397 | B2 | | 4/2004 | Bar | 89/41.02 |
| 7,478,496 | B2 | * | 1/2009 | Bender | 42/94 |
| 7,954,272 | B2 | | 6/2011 | Potterifeld et al. | 42/94 |
| 7,992,339 | B2 | | 8/2011 | Hinds, Jr. | 42/94 |
| 2001/0006018 | A1 | * | 7/2001 | Ang | 89/42.01 |
| 2003/0177897 | A1 | * | 9/2003 | Bar | 89/41.02 |
| 2006/0048642 | A1 | * | 3/2006 | Beckmann | 89/37.03 |
| 2006/0266208 | A1 | * | 11/2006 | Jean-Francois et al. | 89/37.13 |
| 2008/0034954 | A1 | * | 2/2008 | Grober | 89/41.05 |

* cited by examiner

*Primary Examiner* — Bret Hayes
(74) *Attorney, Agent, or Firm* — Gerhard W. Thielman, Esq.

(57) ABSTRACT

A gun mount is provided that includes a first linear actuator, a second linear actuator, and a gimbal. Each of the first linear actuator and second linear actuator is terminated by a ball joint at either end thereof. One ball joint associated with each linear actuator is coupled to a location on a gun where the two locations are proximate to one another. The remaining ball joint associated with each linear actuator is coupled to a support base. An angular relationship is defined between the two linear actuators. The gimbal is one that provides two-degree-of-freedom movement, and is coupled to the gun forward of the ball joint attachment locations. The gimbal further is coupled to the support base so that the gun is supported by the gimbal and the linear actuators.

12 Claims, 3 Drawing Sheets

500

```
% This Matlab code solves actuator input lengths for a desired azimuth and
% elevation angles

clear  all

%User inputs

%desired angles in degrees

az=23;
el=-30;

% Geometric characteristics in inches
G3=30;
G2=5;
G1=3;

C3=17.5;
C2=27.5;
C1=46;


%angle conversion

theta1=(-el/180)*pi;

theta2=(az/180)*pi;


% vectors for actuators
Al1=C1-(-
cos(theta1)*sin(theta2)*G1+sin(theta1)*G2+cos(theta1)*cos(theta2)*G3)
Al2=-C2-(-sin(theta1)*sin(theta2)*G1-
cos(theta1)*G2+sin(theta1)*cos(theta2)*G3)
Al3=C3-(cos(theta2)*G1+sin(theta2)*G3);

Ar1=C1-
(cos(theta1)*sin(theta2)*G1+sin(theta1)*G2+cos(theta1)*cos(theta2)*G3)
Ar2=-C2-(sin(theta1)*sin(theta2)*G1-
cos(theta1)*G2+sin(theta1)*cos(theta2)*G3)
Ar3=-C3-(-cos(theta2)*G1+sin(theta2)*G3)

% Actuator lengths in inches
Ar=sqrt(Ar1^2+Ar2^2+Ar3^2)

Al=sqrt(Al1^2+Al2^2+Al3^2)
```

Fig. 5

PARALLEL ACTUATOR GUN MOUNT

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to gun mounts, and more particularly to a gun mount that provides for adjustment in azimuth and elevation A variety of gun mounts are known in the art. When a gun mount must provide and support adjustments in elevation and azimuth, gun mounts tend to become complex, heavy, and expensive.

SUMMARY

Conventional gun mounts yield disadvantages addressed by various exemplary embodiments of the present invention. Accordingly, various exemplary embodiments provide a gun mount that can adjust a gun in azimuth and elevation, and/or simultaneously make adjustments in azimuth and elevation.

Various exemplary embodiments enable simple construction of azimuth and elevation adjusting gun mount of simple construction. Other objects and advantages of various exemplary embodiments will become more obvious hereinafter in the specification and drawings.

In accordance with various exemplary embodiments, a gun mount includes a first linear actuator, a second linear actuator, and a gimbal. The first linear actuator is terminated by a ball joint at either end thereof. The second linear actuator is terminated by a ball joint at either end thereof.

One ball joint associated with the first linear actuator is coupled to a first location on a gun and the remaining ball joint associated with the first linear actuator is coupled to a support base. One ball joint associated with the second linear is coupled to a second location on the gun in proximity to the first location, and the remaining ball joint associated with the second linear actuator is coupled to the support base.

An angular relationship is defined between the first linear actuator and the second linear actuator. The gimbal is one that provides two-degree-of-freedom movement, and is coupled to the gun forward of the first location and the second location. The gimbal further is coupled to the support base so that the gun is supported by the gimbal, the first linear actuator and the second linear actuator.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which:

FIG. 5 is an exemplary Matlab code for solving actuator lengths.

DETAILED DESCRIPTION

Figure 1:
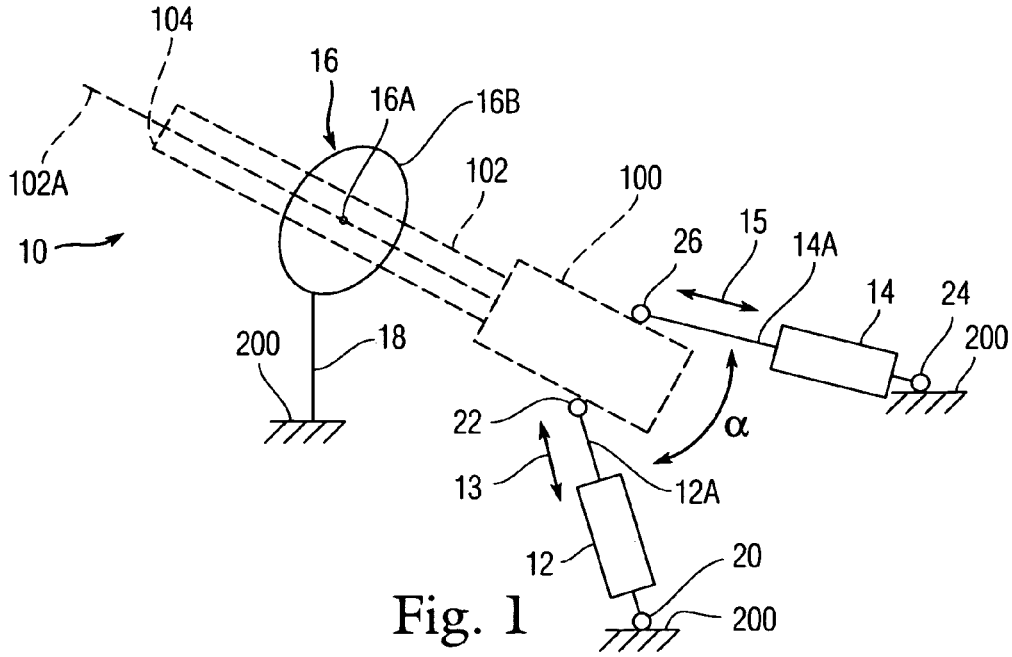
FIG. 1 is a schematic view of an azimuth and elevation adjusting gun mount.
Figure 2:
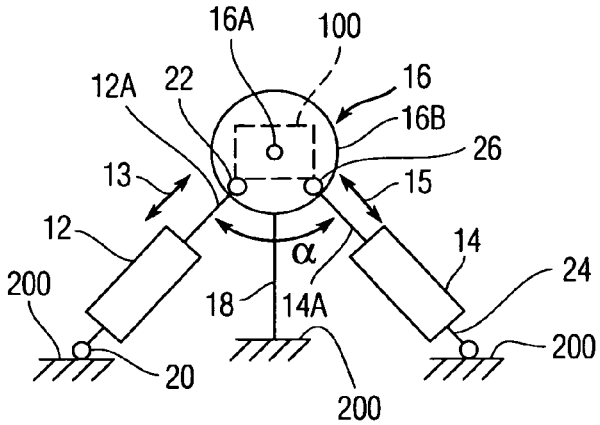
FIG. 2 is a schematic view of the azimuth and elevation adjusting gun mount in FIG. 1 as viewed from the aft end thereof.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention.

Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

In various exemplary embodiments, the gun mount 10 includes two linear actuators 12 and 14, and a gimbal 16, which provides two-degrees-of-freedom (2 DoF) in motion (effectively pitch and yaw). In general, each of linear actuators 12 and 14 is any mechanized/motorized and controllable actuator that generates a linear motive force as indicated by two-headed arrows 13 and 15, respectively.

For example, each of linear actuators 12 and 14 can have respective piston rods 12A and 14A that move linearly along their length as indicated by respective arrows 13 and 15. Gimbal 16 is any such mechanism that provides two-degree-of-freedom movement (i.e., tilting) about its axis 16A. Such gimbal mechanisms are well known in the art. Generally, gimbal 16 includes a fixed and rigid outer ring 16B used to mount gimbal 16 in its application.

Each of linear actuators 12 and 14 is supported at one end thereof by a support base 200, and is coupled at another end thereof to gun stock 100 for support thereby. Linear actuators 12 and 14 extend away from the gun such that an angle $\alpha$ is formed therebetween. Ball joints 20, 22, 24 and 26 are used at each attachment or coupling point.

More specifically, ball joint 20 couples linear actuator 12 to base 200 and ball joint 22 couples the outboard end of piston rod 12A to gun stock 100. In a similar fashion, ball joint 24 couples linear actuator 14 to base 200 and ball joint 26 couples the outboard end of piston rod 14A to gun stock 100. In the illustrated embodiment, ball joints 22 and 26 are in proximity to one another and are positioned equidistant from gimbal 16.

While such positioning simplifies geometrical calculations for azimuth/elevation adjustments, it is to be understood that this is not a requirement of the present invention. The angle $\alpha$ between linear actuators 12 and 14 can be acute, right, or obtuse depending on the application.

Gimbal 16 is located forward of ball joints 22 and 26 where "forward" means that gimbal is closer to the muzzle 104 of barrel 102 than ball joints 22 and 26. For example, gimbal 16 can be coupled to barrel 102 with the gimbal's axis 16A aligned with the longitudinal axis 102A of barrel 102. Gimbal 16 is rigidly coupled to base 200 by, for example, at least one strut 18 coupled to outer ring 16B. In this way, barrel 102 can be tilted through any angle with respect to gimbal axis 16A.

Base 200 is generally a rigid support to prevent any relative movement between each actuator 12 and 14, and between actuators 12, 14 and gimbal 16. Base 200 can be a free-standing base in which case the gun mount 10 can include base 200. Base 200 could also be an independent structure (e.g., building, turret, etc.) to which the above-described elements of gun mount 10 are coupled. Accordingly, it is to be understood that the nature of base 200 is not a limitation of the present invention.

To operate gun mount 10, a controller (not shown) is generally used to control linear movements 13 and 15 of linear actuators 12 and 14, respectively. By virtue of the free-tilting movement provided by gimbal 16 and the ball-joint coupling of linear actuators 12 and 14, barrel 102 is simultaneously adjusted in azimuth and elevation.

The simple two-leg geometry defined by conventional linear actuators 12 and 14 is readily adjusted to a desired azimuth/elevation using basic geometric relationships. The simple linear geometry of actuators 12 and 14 in combination with the two-degrees-of-freedom movement of gimbal 16 provide for any gun orientation change with simple linear movements 13 and 15 to simultaneously adjust barrel 102 in azimuth and elevation.

Figure 3:
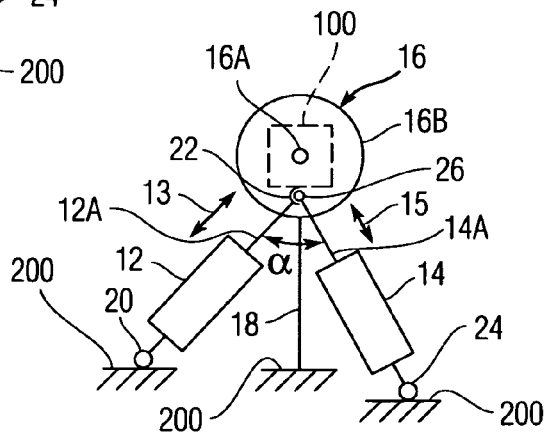
FIG. 3 is an aft-end schematic view of an azimuth and elevation adjusting gun mount in accordance with an alternate embodiment.

Although specific exemplary embodiments have been described, there are numerous variations and modifications that will be readily apparent to those skilled in the art in light of the above teachings. For example, FIG. 3 illustrates another embodiment of the present invention where common reference numerals are used for the elements described earlier herein.

In this embodiment, ball joints 22 and 26 are co-located or defined by a unified ball joint assembly that supports each piston rod 12A and 14A and their respective linear movements 13 and 15. It is therefore to be understood that, within the scope of the appended claims, various additional embodiments of the invention may be practiced other than as specifically described.

Figure 4:
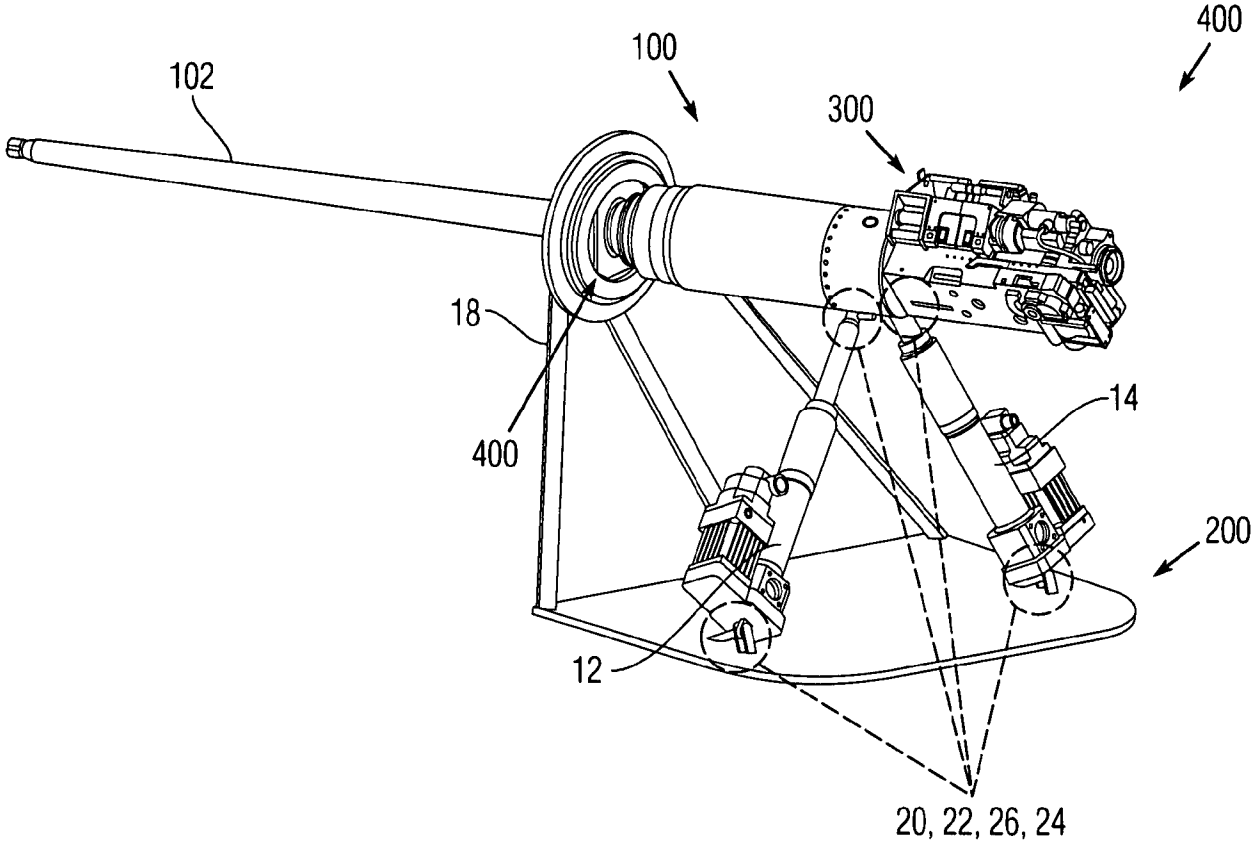
FIG. 4 is a perspective schematic view of the parallel actuator gun mount.

FIG. 4 illustrates a perspective view 400 of the exemplary gun mount 10 featuring gun barrel 102, an ammunition feeder assembly 300 attached to stock 100, forward 2 DoF gimbal 16, linear actuators 12, 14, struts 18, ball joints 20, 22, 24 and 26 and base 200. FIG. 5 shows exemplary Matlab code 500 for determining actuator lengths in response to instructions for specified azimuth and elevation values.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A gun mount, comprising:

a first linear actuator terminated by a ball joint at either end thereof;

a second linear actuator terminated by a ball joint at either end thereof;

one said ball joint associated with said first linear actuator adapted to be coupled to a first location on a gun and a remaining said ball joint associated with said first linear actuator adapted to be coupled to a support base;

one said ball joint associated with said second linear actuator adapted to be coupled to a second location on the gun in proximity to the first location, and a remaining said ball joint associated with said second linear actuator adapted to be coupled to the support base, wherein an angular relationship is defined between said first linear actuator and said second linear actuator; and a gimbal providing two-degree-of-freedom movement, said gimbal adapted to be coupled to the gun forward of the first location and the second location, said gimbal further adapted to be coupled to the support base wherein the gun is supported by said gimbal, said first linear actuator and said second linear actuator.

2. A gun mount as in claim 1, wherein said angular relationship is defined by one of an acute angle, a right angle, and an obtuse angle.

3. A gun mount as in claim 1, wherein the first location and the second location are equidistant from said gimbal.

4. A gun mount as in claim 1, wherein the gun has a barrel and wherein an axis of said gimbal is aligned with a longitudinal axis of the barrel.

5. A gun mount, comprising:

a base;

a first linear actuator;

a second linear actuator;

a first ball joint coupling one end of said first linear actuator to said base;

a second ball joint coupling one end of said second linear actuator to said base;

at least one additional ball joint adapted to couple a remaining end of said first linear actuator to a gun and adapted to couple a remaining end of said second linear actuator to the gun, wherein an angular relationship is defined between said first linear actuator and said second linear actuator; and a gimbal providing two-degree-of-freedom movement, said gimbal coupled to said base and adapted to be coupled to the gun forward of said at least one additional ball joint.

6. A gun mount as in claim 5, wherein said base is rigid.

7. A gun mount as in claim 5, wherein said angular relationship is defined by one of an acute angle, a right angle, and an obtuse angle.

8. A gun mount as in claim 5, wherein each said at least one additional ball joint is equidistant from said gimbal.

9. A gun mount as in claim 5, wherein the gun has a barrel and wherein an axis of said gimbal is aligned with a longitudinal axis of the barrel.

10. A gun mount, comprising:

a rigid base;

a first linear actuator;

a second linear actuator;

a first ball joint coupling one end of said first linear actuator to said base;

a second ball joint coupling one end of said second linear actuator to said base;

at least one additional ball joint adapted to couple a remaining end of said first linear actuator to a gun and adapted to couple a remaining end of said second linear actuator to the gun, wherein an angular relationship is defined between said first linear actuator and said second linear actuator; and a gimbal providing two-degree-of-freedom movement about an axis thereof, said gimbal coupled to said base and adapted to be coupled to the a barrel of the gun forward of said at least one additional ball joint wherein said axis is aligned with the barrel.

11. A gun mount as in claim 10, wherein said angular relationship is defined by one of an acute angle, a right angle, and an obtuse angle.

12. A gun mount as in claim 10, wherein each said at least one additional ball joint is equidistant from said gimbal.

* * * * *